United States Patent [19]

Brand

[11] 3,964,400

[45] June 22, 1976

[54] PALLET OF SYNTHETIC MATERIAL

[75] Inventor: Albertus Brand, Bussum, Netherlands

[73] Assignee: B.V. Houtindustrie"De Phoenix", Halfweg, Netherlands

[22] Filed: Aug. 28, 1974

[21] Appl. No.: 501,284

[30] Foreign Application Priority Data

June 17, 1974 Netherlands ..... 7408025

[52] U.S. Cl. ..... 108/51; 108/58

[51] Int. Cl.[2] ..... B65D 19/32

[58] Field of Search ..... 108/51–58

[56] References Cited

UNITED STATES PATENTS

| | | | |
|---|---|---|---|
| 3,307,504 | 3/1967 | Cloyd et al. | 108/51 X |
| 3,438,342 | 4/1969 | Woolworth et al. | 108/51 |
| 3,526,195 | 9/1970 | Maryonovich | 108/53 |
| 3,598,065 | 8/1971 | Young | 108/53 |
| 3,680,495 | 8/1972 | Pike | 108/53 |
| 3,696,761 | 10/1972 | Brown | 108/53 |
| 3,699,901 | 10/1972 | Cook | 108/58 |
| 3,702,100 | 11/1972 | Wharton | 108/53 X |
| 3,750,596 | 8/1973 | Box | 108/58 X |
| 3,824,933 | 7/1974 | Lind | 108/51 |
| 3,835,792 | 9/1974 | Wharton | 108/51 |

*Primary Examiner*—Roy D. Frazier
*Assistant Examiner*—William E. Lyddane
*Attorney, Agent, or Firm*—Haseltine, Lake & Waters

[57] ABSTRACT

A pallet of synthetic material comprising an upper platform, a lower platform and upright hollow columns which interconnect the upper and the lower platform, wherein the columns are integrally formed with the upper platform and comprise lower, downwardly extending locking hooks which are snapped through upright locking holes in the lower platform and which are received within the lower platform.

8 Claims, 11 Drawing Figures

PALLET OF SYNTHETIC MATERIAL

BACKGROUND OF THE INVENTION

The invention relates to a pallet of synthetic material comprising an upper platform, a lower platform and upright hollow columns which interconnect the upper and the lower platform.

In a known embodiment of such a pallet made of synthetic material, the hollow columns are constituted by separate members which are connected in a relatively weak manner to the upper platform and to the lower platform. This known pallet thus entails the risk that the connection between the columns and the upper and/or the lower platform gives way under operational loads.

SUMMARY OF THE INVENTION

It is an object of the present invention to provide an extremely strong pallet of synthetic material.

To this end, the pallet according to the invention is characterized in that the columns are integrally formed with the upper platform and comprise lower, downwardly extending locking hooks which are snapped through upright locking holes in the lower platform and which are received within the lower platform.

According to the invention the columns no longer are separate members, but they are integral with the upper platform. Furthermore, the connection between the columns and the lower platform is particularly sturdy, so that high loads can be resisted.

Preferably, the hooked portion of each locking hook has a substantially oval cross section, the longitudinal axis of which is approximately parallel to the outer edge of the portion of the lower side of the column at which the locking hook is formed, while the shank portion above the hooked portion of each locking hook is flattened on one side and widens upwardly, towards the column.

In a particularly sturdy embodiment of the pallet according to the invention, the lower platform is composed of a top wall and of downwardly extending stiffening ribs formed underneath this top wall, the upright wall of each column being aligned with an annular stiffening rib of the lower platform, and the locking holes being provided in the lower platform at the location of these annular stiffening ribs.

The locking holes may extend over the entire height of the annular stiffening ribs of the lower platform, while the hooked portions of the locking hooks engage underneath the top wall of the lower platform.

The use of nine columns, of which the outer columns comprise four locking hooks and the central inner column comprises eight locking hooks, is considered particularly favourable.

The top wall of the lower platform may comprise a rectangular framework portion of which the width substantially corresponds to the width of the outer columns positioned thereabove, while the central areas of the opposite sides of this framework portion may be connected to each other by central strips which join in the central zone of this top wall above which the central inner column is located.

The upper platform may consist of a top wall, underneath which the columns as well as downwardly extending stiffening ribs are formed.

BRIEF DESCRIPTION OF THE DRAWINGS

The invention will hereinafter be further explained with reference to the drawings, which illustrate an embodiment of a pallet of synthetic material according to the invention.

DESCRIPTION OF A PREFERRED EMBODIMENT

Figure 2:
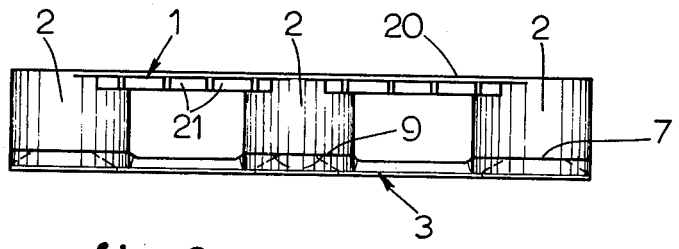
FIG. 2 is a front view of the pallet according to FIG. 1.
Figure 1:
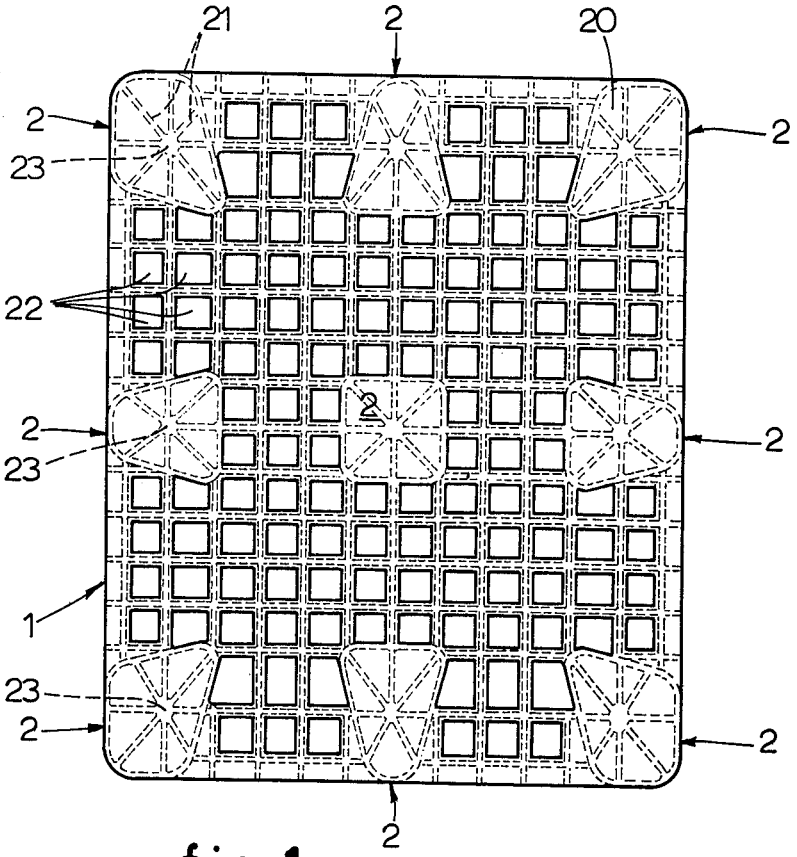
FIG. 1 is a top view of an embodiment of a pallet of synthetic material according to the invention.
Figure 3:
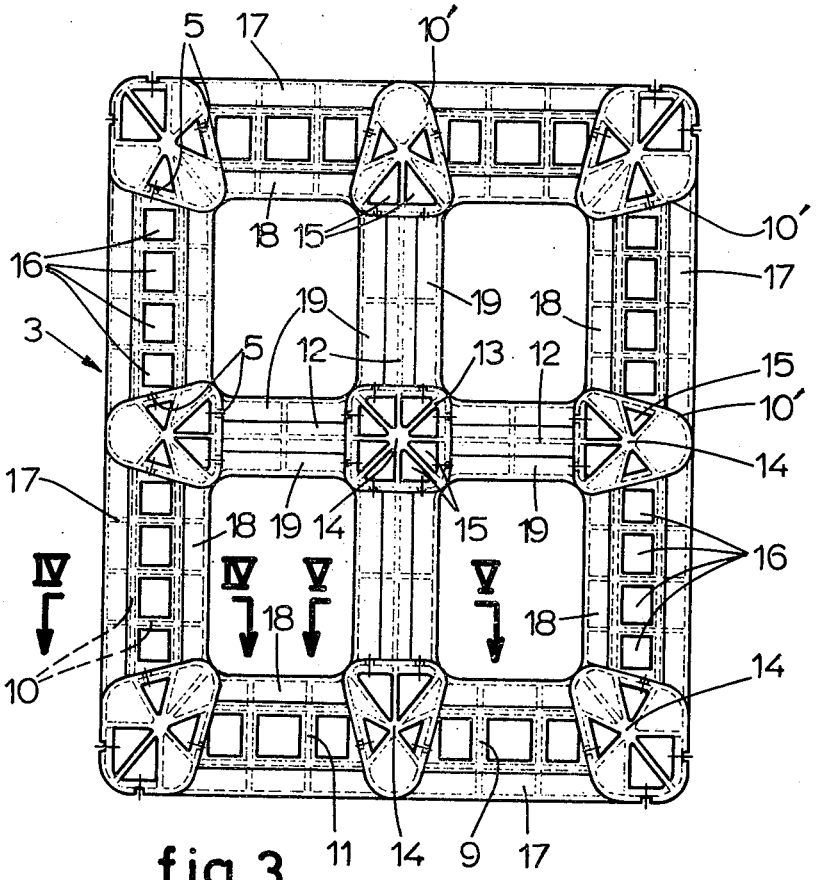
FIG. 3 is a top view of the lower platform of the pallet according to FIG. 1.

The drawing illustrates an embodiment of a pallet according to the invention made of synthetic material, such as low-pressure structural foam, in particular low-pressure polyethylene of high molecular weight.

This pallet is composed of an upper platform 1 with which underlying hollow columns 2 are integrally formed, and of a lower platform 3. In the operating position the upper platform 1 and the lower platform 3 are substantially horizontal, the columns 2 then having a vertical position. The connection between the columns 2 and the lower platform 3 is brought about by lower locking hooks 4 depending from the columns 2. These hooks 4 are snapped through upright locking holes 5 in the lower platform 3, and are received within the lower platform 3.

Figure 6:
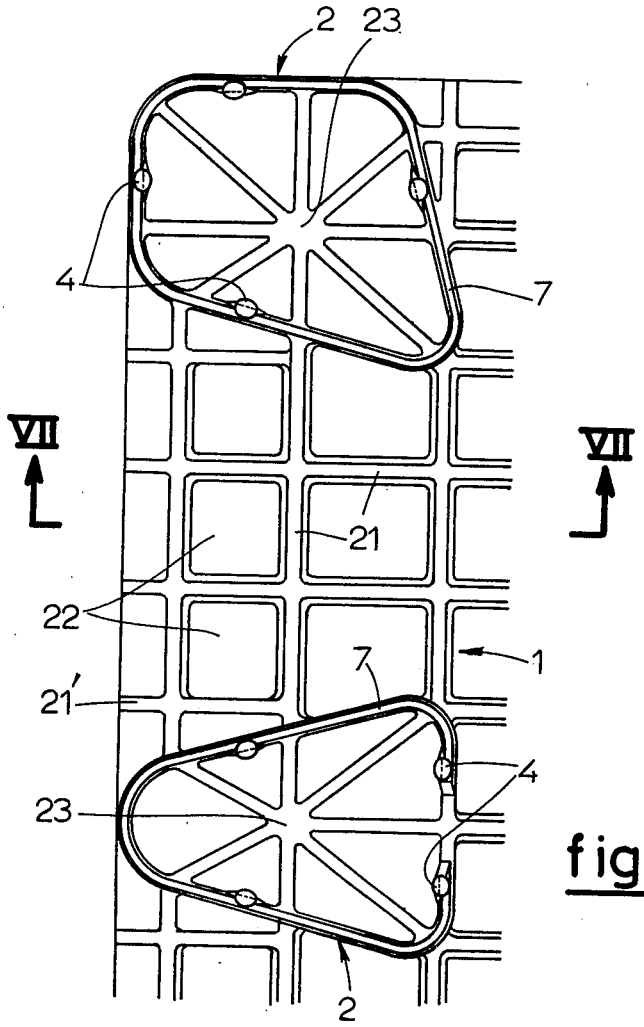
FIG. 6 is a partial bottom view of the upper platform and of the underlying columns of the pallet according to FIG. 1.
Figure 10:
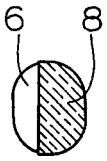
FIG. 10 is a section along the plane X—X in FIG. 8.
Figure 11:
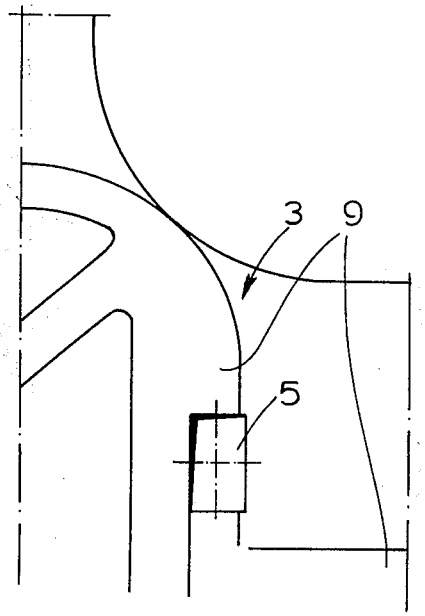
FIG. 11 is a top view of the portion of the lower platform shown in FIG. 8.

The hooked portion 6 of each locking hook 4 has a substantially oval cross-section, the longitudinal axis of which is approximately parallel to the outer edge of the portion of the lower side 7 of the column 2 at which the locking hook 4 is formed. The shank portion 8 above the hooked portion 6 of each locking hook 4 is flattened on one side (FIG. 10) and widens upwardly towards the column 2. Each locking hook 4 is located within the outline of its column 2 (FIG. 6).

The locking holes 5 in the lower platform 3 have a rectangular cross-section which is slightly smaller than the cross-section of the hooked portion 6 of each locking hook 4 and which substantially corresponds to the cross-section of the shank portion 8 of the locking hook 4 above the hooked portion 6.

The lower platform 3 is composed of a top wall 9 and of downwardly extending auxiliary stiffening ribs 10 formed underneath this top wall 9.

The upright wall of each column 2 is aligned with a main stiffening rib 10' of the lower platform 3. The locking holes 5 are provided in the lower platform 3 at the location of these main stiffening ribs 10'. The hooked portions 6 of the locking elements 4 engage underneath the top wall 9 of the lower platform 3, while the columns 2 are supported upon this top wall 9 of the lower platform 3.

The pallet shown in the drawing by way of example comprises nine columns 2. The outer columns 2 are equipped with four locking hooks 4 and the central inner column 2 is equipped with eight locking hooks 4.

The top wall 9 of the lower platform 3 comprises a rectangular framework portion 11, the width of which substantially corresponds to the width of the outer columns 2 positioned thereabove. The central areas of the opposite sides of this framework portion 11 are connected to each other by central strips 12 having a slightly smaller height. These strips 12 join in the central zone 13 of this top wall 9 above which the central inner column 2 is located.

The upright wall of the central inner column 2 and the main stiffening rib 10' of the lower platform 3 which is in line therewith have a substantially rectangular cross-section.

Within each main stiffening rib 10' underneath the top wall 9 of the lower platform 3, a number of downwardly directed auxiliary stiffening ribs 10 formed underneath this top wall extend from a central junction 14 to this main stiffening rib 10'.

The areas of the top wall 9 of the lower platform 3 defined by the main stiffening ribs 10' are provided with holes 15 which are bounded by successive auxiliary stiffening ribs 10 which extend towards the central junction 14.

The framework portion 11 of the top wall 9 of the lower platform 3 is furthermore provided with rectangular openings 16. Underneath this framework portion 11, downwardly extending auxiliary stiffening ribs 10 are formed which are parallel to the edges of these openings 16.

Figure 4:
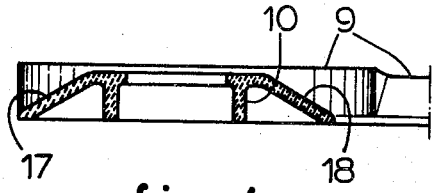
FIG. 4 is a section along the plane IV—IV in FIG. 3 on a larger scale.

The framework portion 11 of the top wall 9 of the lower platform 3 further comprises an outer, downwardly and outwardly extending guide edge 17 and a downwardly and inwardly extending inner edge 18 between successive columns 2 (FIG. 4).

Underneath the guide edge 17 and underneath the inner edge 18 of the framework portion 11 of the top wall 9 of the lower platform 3, downwardly extending auxiliary stiffening ribs 10 are formed which connect to the auxiliary stiffening ribs 10 provided between successive rectangular openings 16.

Figure 5:
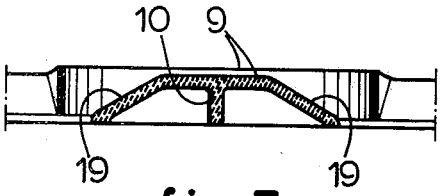
FIG. 5 is a section along the plane V—V in FIG. 3 on a larger scale.

The central strips 12 of the top wall 9 of the lower platform 3 comprise on both sides a downwardly and outwardly extending guide edge 19 (FIG. 5).

Furthermore, downwardly extending longitudinal and transverse auxiliary stiffening ribs 10 are formed underneath the central strips 12 of the top wall 9 of the lower platform 3.

The upper platform 1 consists of a top wall 20, underneath which the columns 2 and downwardly extending stiffening ribs 21 are formed.

The top wall 20 of the upper platform 1 is provided with a plurality of substantially rectangular openings 22. Downwardly extending stiffening ribs 21 formed underneath this top wall 20 and covering the entire length and the entire width of the upper platform 1 are parallel to the edges of these openings 22.

The top wall 20 of the upper platform 1 has a continuous surface above the columns 2. A plurality of downwardly extending stiffening ribs 21 are formed within each column 2 underneath the top wall 20 and extend between a central junction 23 and the upright wall of the column 2. These stiffening ribs 21 are aligned with the auxiliary stiffening ribs 10 extending within the main stiffening ribs 10' underneath the top wall 9 of the lower platform 3.

A number of the stiffening ribs 21 extending within the columns 2 connect to stiffening ribs 21 located outside the columns 2 and formed underneath the top wall 20 of the upper platform 1. The stiffening ribs 21 within the columns 2 extend preferably over the entire height of the columns 2.

Figure 7:
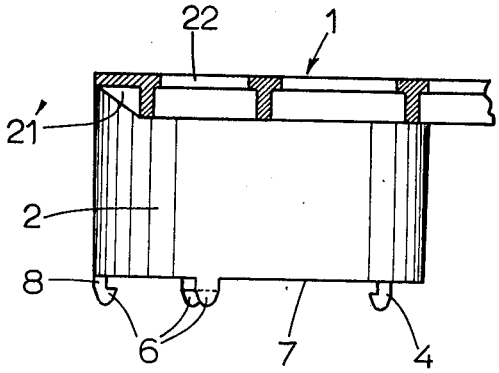
FIG. 7 is a section along the plane VII—VII in FIG. 6.
Figure 8:
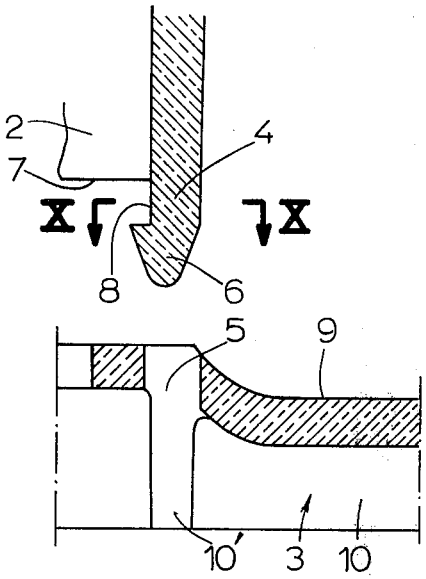
FIG. 8 is a section of a locking hook as well as of a portion of the lower platform in which a locking hole is formed.
Figure 9:
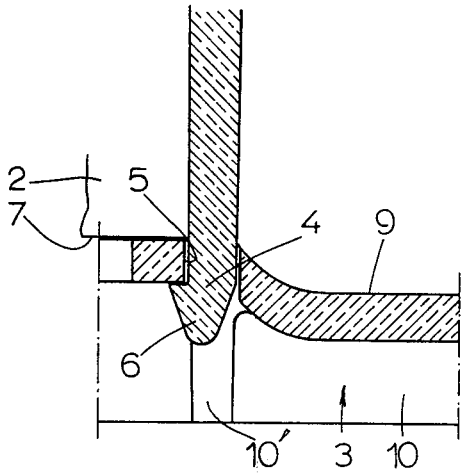
FIG. 9 is a section corresponding to FIG. 8, wherein the locking hook is snapped through the locking hole in the lower platform.

Downwardly extending stiffening ribs 21', formed underneath the outer edge zones of the top wall 20 of the upper platform 1 between successive columns 2, are provided above the outer downwardly and outwardly extending guide edge 17 of the framework portion 11 of the top wall 9 of the lower platform 3. These stiffening ribs 21', extending perpendicularly to the appertaining outer edge of the upper platform 1, decrease in height in the outward direction (FIG. 7). The introduction of the forks of a fork lift truck into the pallet is thus facilitated, and damage to the pallet is prevented. In order to contribute even more to an easy introduction of the forks of a fork lift truck into the pallet, at least the outer upright wall portions of the outer columns 2 are rounded, while the top wall 20 of the upper platform 1, the top wall 9 of the lower platform 3 and the columns 2 which connect the corner zones of the upper platform 1 and of the lower platform 3 have aligned rounded corners. Further, the upright wall portions of successive outer columns 2 which face each other converge inwardly, as shown, for example, in FIG. 6.

The pallet made of synthetic material according to the invention is of a very rigid construction due to the fact that the columns 2 at their upper end are integrally formed with the upper platform 1 and are connected at their lower end in a particularly sturdy manner to the lower platform 3 by means of the locking hooks 4 which are snapped through the locking holes 5. Further, the stiffening ribs 10, 10' together with the top wall 9 of the lower platform 3 and the stiffening ribs 21, 21' together with the top wall 20 of the upper platform 1 more or less act as T-sections. These T-sections, many of which cover the entire length and the entire width of the pallet again increase the rigidity of the pallet.

The design of the lower platform 3 as well as the use of the holes 15 and the rectangular openings 16 in the top wall 9 of the lower platform 3 and of the rectangular openings 22 in the top wall 20 of the upper platform 1 result in substantial savings in weight and further reduce the cost of materials of the pallet according to the invention.

The invention is not restricted to the embodiment shown in the drawings, which may be varied in several manners within the scope of the appended claims.

I claim:

1. A pallet of synthetic material comprising an upper platform; a lower platform having locking holes therein, nine upright hollow columns interconnecting said upper and said lower platform, each column having an upright outer wall defining the periphery thereof, said columns comprising eight outer columns and a central inner column, four of said outer columns being positioned in the corners of the pallet and the other four outer columns being each positioned intermediate two corners of the pallet, downwardly extending locking hooks at the lower ends of each of said column, said hooks being snapped through said locking holes in said lower platform, said upper platform and said columns jointly forming an integral unit, said lower platform forming an integral unit, each said locking hook being located within the cross-sectional dimensions of its respective column, said lower platform including a perforated top wall, nine downwardly extending main stiffening ribs being formed underneath said top wall, the upright outer wall of each said column being aligned with one each of said main stiffening ribs of the lower platform, each main stiffening rib defining a periphery corresponding to that of the aligned upright outer wall of its corresponding column, auxiliary downwardly extending stiffening ribs extending between each main stiffening rib and a central junction, said locking holes in the lower platform being located proximate said main stiffening ribs and having a rectangular cross-section, said locking hooks engaging underneath the perforated top wall, said top wall of said lower platform including a rectangular framework portion, the width of said framework portion substantially corresponding to the width of said other four outer columns positioned thereabove, central strips joining in the central zone of said top wall above which said central inner column is located, connecting the central area of opposite sides of said framework portion to each other, said framework portion of the top wall of the lower platform including outer downwardly and outwardly extending guide edges positioned between successive main stiffening ribs, the upper platform comprising a perforated top wall, and downwardly extending stiffening ribs formed underneath said top wall, and a plurality of downwardly extending stiffening ribs being formed within each column extending between the upright wall of said column and a central junction.

2. A pallet according to claim 1, wherein the framework portion of the top wall of the lower platform has rectangular openings, downwardly extending further stiffening ribs extending in parallel with the edges of said openings being formed below said framework portion.

3. A pallet according to claim 2, wherein the framework portion of the top wall of the lower platform comprises downwardly and inwardly extending inner edges between successive of said main stiffening ribs.

4. A pallet according to claim 3, wherein downwardly extending auxiliary stiffening ribs are formed below the guide edges of the framework portion of the top wall of the lower platform, said auxiliary stiffening ribs being connected to said further stiffening ribs extending between said successive rectangular openings.

5. A pallet according to claim 4, wherein said central strips of the top wall of the lower platform each comprise downwardly and outwardly extending guide edges on both sides thereof.

6. A pallet according to claim 5, wherein downwardly extending longitudinal and transverse stiffening ribs are formed below the central strips of the top wall of the lower platform.

7. A pallet according to claim 6, wherein the top wall of the upper platform is provided with a plurality of substantially rectangular openings, downwardly extending stiffening ribs being formed below said top wall and covering the entire length and the entire width of the upper platform parallel to the edges of said openings.

8. A pallet according to claim 7, wherein said downwardly extending stiffening ribs below the outer edge zones of the top wall of the upper platform between successive outer columns extend perpendicular to the adjacent outer edge and decrease in height in the outward direction, at least outer upright wall portions of said other four outer columns being rounded, the top wall of the upper platform, the top wall of the lower platform and said four outer columns positioned in the corners of the pallet having aligned and rounded corners, the upright wall portions of successive outer columns facing each other inwardly converging.

* * * * *